US007981277B2

(12) United States Patent
Subramanian et al.

(10) Patent No.: US 7,981,277 B2
(45) Date of Patent: Jul. 19, 2011

(54) INTEGRATED SOLVENT DEASPHALTING AND DEWATERING

(75) Inventors: Anand Subramanian, Sugar Land, TX (US); Raymond Floyd, Katy, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 562 days.

(21) Appl. No.: 11/965,049

(22) Filed: Dec. 27, 2007

(65) Prior Publication Data

US 2009/0166266 A1 Jul. 2, 2009

(51) Int. Cl.
*C10C 3/08* (2006.01)

(52) U.S. Cl. ..... 208/309; 208/45; 208/87; 208/187

(58) Field of Classification Search ..... None
See application file for complete search history.

(56) References Cited

U.S. PATENT DOCUMENTS

| | | | | |
|---|---|---|---|---|
| 2,940,920 | A | 6/1960 | Garwin | |
| 3,975,396 | A | 8/1976 | Bushnell et al. | |
| 4,039,429 | A | 8/1977 | van Klinken et al. | |
| 4,191,639 | A | 3/1980 | Audeh et al. | |
| 4,200,519 | A | 4/1980 | Kwant et al. | |
| 4,290,880 | A | 9/1981 | Leonard | |
| 4,324,651 | A | 4/1982 | Rollmann et al. | |
| 4,354,922 | A | 10/1982 | Derbyshire et al. | |
| 4,354,928 | A | 10/1982 | Audeh et al. | |
| 4,421,639 | A | 12/1983 | Lambert et al. | |
| 4,440,633 | A | 4/1984 | Jacquin et al. | |
| 4,482,453 | A | 11/1984 | Coombs et al. | |
| 4,502,950 | A | 3/1985 | Ikematsu et al. | |
| 4,525,269 | A | 6/1985 | Ikematsu et al. | |
| 4,547,292 | A | 10/1985 | Zarchy | |
| 4,755,278 | A * | 7/1988 | Baumgartner | 208/45 |
| 4,810,367 | A | 3/1989 | Chombart et al. | |
| 4,933,067 | A | 6/1990 | Rankel | |
| 5,089,114 | A | 2/1992 | Tovar et al. | |
| 5,192,421 | A | 3/1993 | Audeh et al. | |
| 5,843,303 | A | 12/1998 | Ganeshan | |
| 5,914,010 | A | 6/1999 | Hood et al. | |
| 5,919,355 | A | 7/1999 | Hood | |
| 6,007,709 | A * | 12/1999 | Duyvesteyn et al. | 208/391 |
| 6,074,558 | A * | 6/2000 | Duyvesteyn et al. | 210/611 |
| 6,274,032 | B2 | 8/2001 | Hood et al. | |
| 6,332,975 | B1 | 12/2001 | Abdel-Halim et al. | |
| 6,524,469 | B1 | 2/2003 | Schucker | |
| 6,533,925 | B1 | 3/2003 | Wallace et al. | |
| 7,144,498 | B2 | 12/2006 | McCall et al. | |
| 2006/0283776 | A1 * | 12/2006 | Iqbal et al. | 208/86 |

* cited by examiner

*Primary Examiner* — Tam M Nguyen
(74) *Attorney, Agent, or Firm* — KBR IP Legal Dept.

(57) ABSTRACT

A method for dewatering and deasphalting a hydrocarbon feed is provided. A hydrocarbon feed containing one or more hydrocarbons, asphaltenes and water can be mixed or otherwise combined with one or more solvents. The addition of the solvent sufficiently decreases the density of the hydrocarbon feed to enable gravity settling of the water phase, providing an oil phase containing one or more hydrocarbons, asphaltenes and solvents. The asphaltenes can be separated from the oil phase to provide an asphaltene mixture containing asphaltenes and a portion of the solvents and a deasphalted oil containing one or more hydrocarbons and the balance of the solvents. The solvents can be separated from the asphaltenes and deasphalted oil, and recycled to the initial mixing step wherein the solvent is mixed or otherwise combined with one or more solvents.

20 Claims, 4 Drawing Sheets

INTEGRATED SOLVENT DEASPHALTING AND DEWATERING

BACKGROUND

1. Field

The present embodiments generally relate to systems and methods for deasphalting and dewatering hydrocarbons. More particularly, embodiments of the present invention relate to systems and methods for dewatering crude oil using solvent from residual oil extraction.

2. Description of the Related Art

Crude oil typically contains a large amount of water that must be separated prior to upgrading. Dewatering is an expensive step in the process of upgrading crude oil for transportation and/or refining due to the slight differences in specific gravity between the oil and water. Large separation vessels, for example, have been used to phase separate the water from the oil, but such approach is extremely time consuming and inefficient. Heating the oil and water to increase the density difference has also been used, as have specialty chemicals to assist in the separation. However, such techniques are capital cost intensive and expensive to operate and maintain.

A need exists for an improved process to dewater crude oils while minimizing capital investment.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Systems and methods for deasphalting and dewatering hydrocarbons are provided. In at least one specific embodiment, a hydrocarbon feed containing one or more hydrocarbons, asphaltenes and water can be mixed or otherwise combined with one or more solvents. The solvent addition can decrease the density of the hydrocarbons to provide a heavier aqueous phase and a lighter oil phase, which can be more easily and efficiently separated from one another at ambient conditions. In other words, no additional energy input is required.

The oil phase can contain the one or more hydrocarbons, asphaltenes and solvents. The asphaltenes can then be separated from the hydrocarbons and solvent to provide an asphaltene-rich mixture and a deasphalted oil mixture. The asphaltene-rich mixture can include the asphaltenes and a portion of the solvents. The deasphalted oil mixture can include the hydrocarbons and the balance of the solvents. The solvents can be separated from the asphaltene-rich mixture and/or the deasphalted oil mixture, and recycled to the hydrocarbon feed for dewatering. The term "asphaltenes" as used herein refers to a hydrocarbon or mixture of hydrocarbons that are insoluble in n-alkanes, yet is totally or partially soluble in aromatics such as benzene or toluene.

Figure 1:
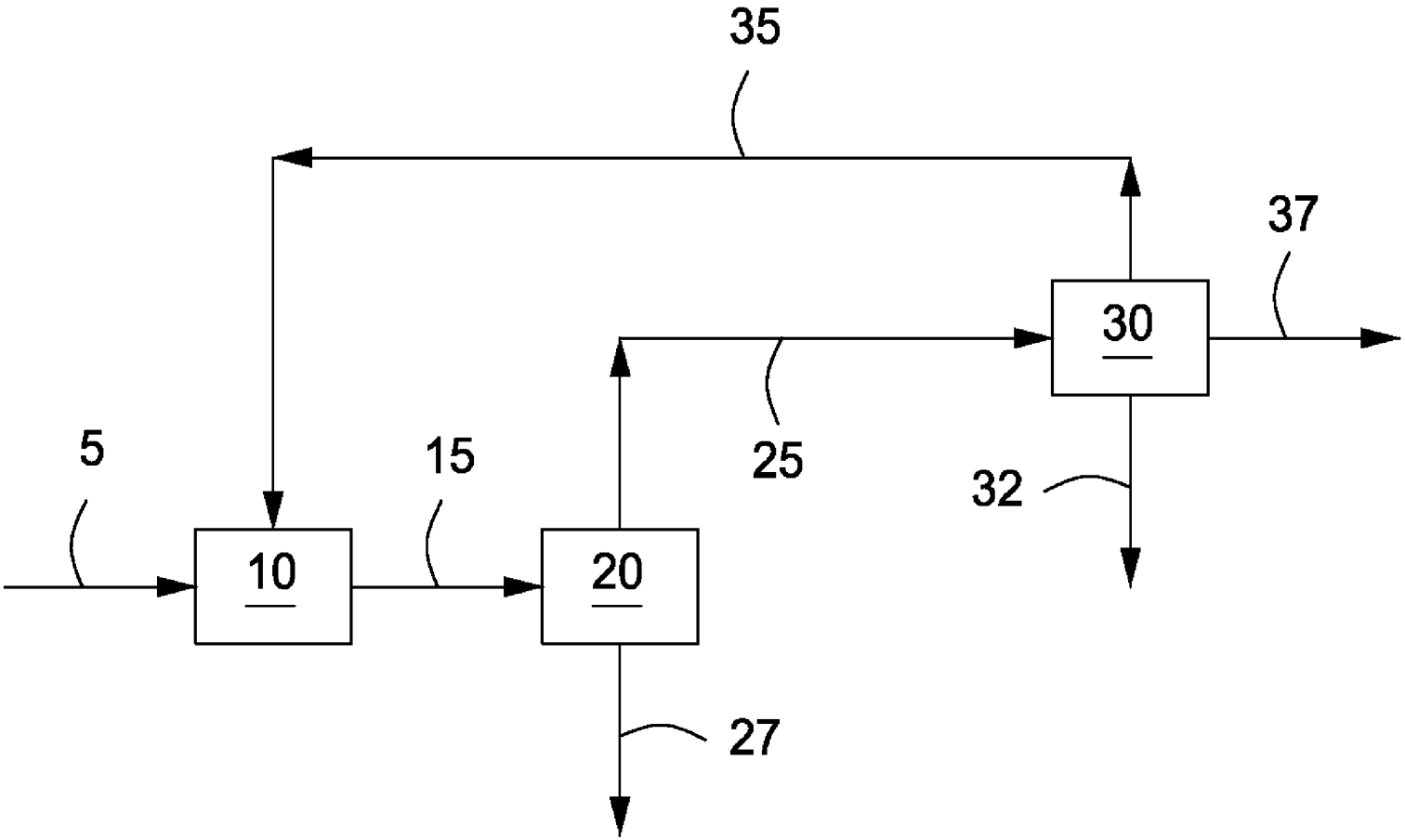
FIG. 1 depicts an illustrative solvent deasphalting and dewatering system, according to one or more embodiments described.

FIG. 1 depicts an illustrative solvent deasphalting and dewatering system, according to one or more embodiments. The system can include one or more mixers 10, separators 20 and solvent extraction units 30. A hydrocarbon feed to be dewatered can be introduced to the one or more mixers 10 via line 5, where the hydrocarbon feed can be contacted with one or more solvents via line 35. The hydrocarbon feed and the solvent(s) can be mixed or otherwise contacted within the mixer 10 to provide a mixture of the hydrocarbons and solvent (s) ("first mixture") in line 15.

The hydrocarbon feed in line 5 can be or include whole crude oil, crude oil, oil shales, oil sands, tars, bitumens, combinations thereof, derivatives thereof or mixtures thereof. In one or more embodiments, the hydrocarbon feed can be one or more hydrocarbons having an API@60° F. (ASTM D4052) of less than 35 or less than 25. The API can also range from about 6 to about 25 or about 8 to about 15. In one or more embodiments, the hydrocarbon feed can be or include one or more hydrocarbons having a normal, atmospheric, boiling point of less than 1,090° C. (2,000° F.). In one or more embodiments, the hydrocarbon feed can be or include one or more asphaltenes.

As will be explained in more detail below, the one or more solvents via line 35 can be recycled from the solvent extraction unit 30. The presence of the solvent facilitates the separation of the water from the crude oil. Any solvent that can differentiate the density of the oil and water to facilitate a phase separation therebetween can be used. For example, suitable solvents can include but are not limited to aliphatic hydrocarbons, cycloaliphatic hydrocarbons, and aromatic hydrocarbons, and mixtures thereof. In one or more embodiments, the one or more solvents can include propane, butane, pentane, benzene, or mixtures thereof. In one or more embodiments, the one or more solvents can include at least 90% wt, at least 95% wt, or at least 99% wt of one or more hydrocarbons having a normal boiling point below 538.0° C. (1,000° F.). In one or more embodiments, the solvent(s) can include one or more gas condensates having a boiling range of about 27° C. (80° F.) to about 121° C. (250° F.); one or more light naphthas having a boiling range of about 32° C. (90° F.) to about 82° C. (180° F.); one or more heavy naphthas having a boiling range of about 82° C. (180° F.) to about 221° C. (430° F.); or mixtures thereof. In one or more embodiments, the solvent(s) can have a critical temperature of about 90° C. (195° F.) to about 538° C. (1,000° F.); about 90° C. (195° F.) to about 400° C. (750° F.); or about 90° C. (195° F.) to about 300° C. (570° F.). In one or more embodiments, the solvent(s) can have a critical pressure of about 2,000 kPa (275 psig) to about 6,000 kPa (855 psig); about 2,300 kPa (320 psig) to about 5,800 (830 psig) kPa; or about 2,600 kPa (365 psig) to about 5,600 kPa (800 psig). In one or more embodiments, the solvent in line 35 can be partially or completely vaporized. In one or more embodiments, the solvent in line 35 can be greater than about 50% wt vapor; greater than about 75% wt vapor; greater than about 90% wt vapor; or greater than about 95% wt vapor with the balance liquid solvent.

The first mixture can exit the mixer 10 via line 15 and can be introduced to the one or more separators 20. In one or more embodiments, the one or more mixers 10 can include but are not limited to ejectors, inline static mixers, inline mechanical/power mixers, homogenizers, or combinations thereof. In one or more embodiments, the one or more mixers 10 can include one or more columns containing trays, random packing, structured packing, or other internals suitable for mixing or otherwise combining one or more liquids and one or more vapors. The separator 20 can be any system or device capable of phase separating the mixture. For example, the separator 20 can be or include any one or more gravity separators and coalescer-assisted separators. Chemical-assisted and/or plate assisted separators can also be used. In one or more embodiments, the first mixture in line 15 can be heated and/or cooled to further differentiate the specific gravity of the oil phase and the water phase to improve the overall separation efficiency.

Within the one or more separators 20, the density difference between the hydrocarbon and water phases permits a phase separation to occur. Although not shown, the water phase removed from the separator 20 via line 27 can be further processed and/or treated to remove entrained hydrocarbons and other contaminants prior to recycle, reuse, and/or disposal. The oil phase ("hydrocarbons") removed via line 25 from the separator 20 can contain the one or more hydrocarbons, including asphaltenes, from the hydrocarbon feed in addition to the solvent added in the mixer 10. In one or more embodiments, the feedstock in line 25 can have a specific gravity (at 60° F.) of about −5° API to about 35° API; or about 6° API to about 20° API. In one or more specific embodiments, the hydrocarbon in line 25 can have a specific gravity (at 60°) of less than 35° API, or more preferably less than 25° API. The hydrocarbon in line 25 can have a solvent to feedstock dilution ratio of about 1:1 to about 100:1; about 2:1 to about 10:1; or about 3:1 to about 6:1. The solvent concentration in line 25 can range from about 50% wt to about 99% wt; 60% wt to about 95% wt; or about 66% wt to about 86% wt with the balance feedstock. The concentration of the hydrocarbon in line 25 can range from about 1% wt to about 50% wt, from about 5% wt to about 40% wt, or from about 14% wt to about 34% wt with the balance solvent.

The hydrocarbon and asphaltenes within line 25 can be selectively separated within the one or more extraction units 30 to provide the asphaltenes via line 32, and deasphalted oil via line 37. The solvent can be recovered from the extraction unit 30 and recycled to the mixer 10 via line 35. In one or more embodiments, the extraction unit 30 can operate at sub-critical, critical, or supercritical temperatures and/or pressures with respect to the solvent to permit separation of the asphaltenes from the oil.

Figure 2:
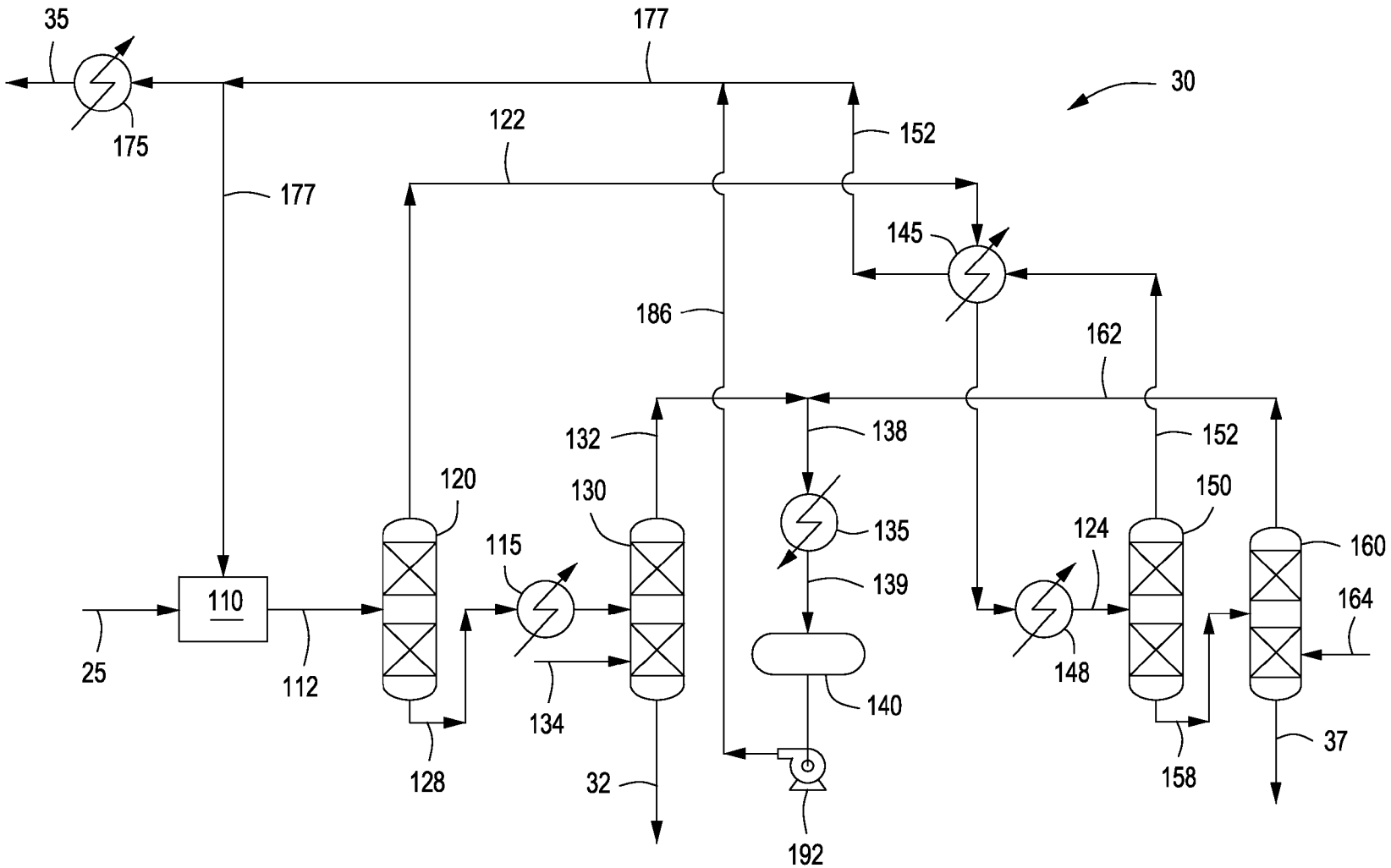
FIG. 2 depicts an illustrative solvent extraction system for use with an integrated deasphalting and dewatering system, according to one or more embodiments described.

FIG. 2 depicts an illustrative solvent extraction system 30, according to one or more embodiments. The extraction system 30 can include one or more mixers 110, separators 120, 150, and strippers 130, 160. Any number of mixers, separators, and strippers can be used depending on the volume of the hydrocarbon to be processed. In one or more embodiments, the hydrocarbon feed via line 25 and the one or more solvent (s) via line 177 can be mixed or otherwise combined within the one or more mixers 110 to provide a hydrocarbon mixture in line 112. The solvent-to-feedstock weight ratio can vary depending upon the physical properties and/or composition of the feedstock. For example, a high boiling point feedstock can require greater dilution with low boiling point solvent(s) to obtain the desired bulk boiling point for the resultant mixture. The hydrocarbon mixture in line 112 can have a solvent-to-feedstock dilution ratio of about 1:1 to about 100:1; about 2:1 to about 10:1; or about 3:1 to about 6:1.

The one or more mixers 110 can be any device or system suitable for batch, intermittent, and/or continuous mixing of the feedstock(s) and solvent(s). The mixer 110 can be capable of homogenizing immiscible fluids. Illustrative mixers can include but are not limited to ejectors, inline static mixers, inline mechanical/power mixers, homogenizers, or combinations thereof. The mixer 110 can operate at temperatures of about 25° C. (80° F.) to about 600° C. (1,110° F.); about 25° C. (80° F.) to about 500° C. (930° F.); or about 25° C. (80° F.) to about 300° C. (570° F.). The mixer 110 can operate at a pressure slightly higher than the pressure of the separator 120. In one or more embodiments, the mixer can operate at a pressure of about 101 kPa (0 psig) to about 700 kPa (100 psig) above the critical pressure of the solvent(s) ("$P_{C,S}$"); about $P_{C,S}$−700 kPa ($P_{C,S}$−100 psig) to about $P_{C,S}$+700 kPa ($P_{C,S}$+100 psig); or about $P_{C,S}$−300 kPa ($P_{C,S}$−45 psig) to about $P_{C,S}$+300 kPa ($P_{C,S}$+45 psig).

The hydrocarbon mixture in line 112 can be introduced to the one or more separators ("asphaltene separators") 120 to provide an overhead via line 122 and a bottoms via line 128. The overhead in line 122 can contain deasphalted oil ("DAO") and a first portion of the one or more solvent(s). The bottoms in line 128 can contain insoluble asphaltenes and the balance of the solvent. In one or more embodiments, the DAO concentration in line 122 can range from about 1% wt to about 50% wt; about 5% wt to about 40% wt; or about 14% wt to about 34% wt. In one or more embodiments, the solvent concentration in line 122 can range from about 50% wt to about 99% wt; about 60% wt to about 95% wt; or about 66% wt to about 86% wt. In one or more embodiments, the density (API@60° F.) of the overhead in line 122 can range from about 10° to about 100°; about 30° to about 100°; or about 50° to about 100°.

In one or more embodiments, the asphaltene concentration in the bottoms in line 128 can range from about 10% wt to about 99% wt; about 30% wt to about 95% wt; or about 50% wt to about 90% wt. In one or more embodiments, the solvent concentration in line 128 can range from about 1% wt to about 90% wt; about 5% wt to about 70% wt; or about 10% wt to about 50% wt.

The one or more separators 120 can be any system or device suitable for separating one or more asphaltenes from the hydrocarbon feed and solvent mixture to provide the overhead in line 122 and the bottoms in line 128. In one or more embodiments, the separator 120 can include bubble trays, packing elements such as rings or saddles, structured packing, or combinations thereof. In one or more embodiments, the separator 120 can be an open column without internals. In one or more embodiments, the separators 120 can operate at a temperature of about 15° C. (60° F.) to about 150° C. (270° F.) above the critical temperature of the one or more solvent(s) ("$T_{C,S}$"); about 15° C. (60° F.) to about $T_{C,S}$+

100° C. ($T_{C,S}$+180° F.); or about 15° C. (60° F.) to about $T_{C,S}$+50° C. ($T_{C,S}$+90° F.). In one or more embodiments, the separators 120 can operate at a pressure of about 101 kPa (0 psig) to about 700 kPa (100 psig) above the critical pressure of the solvent(s) ("$P_{C,S}$"); about $P_{C,S}$−700 kPa ($P_{C,S}$−100 psig) to about $P_{C,S}$+700 kPa ($P_{C,S}$+100 psig); or about $P_{C,S}$−300 kPa ($P_{C,S}$−45 psig) to about $P_{C,S}$+300 kPa ($P_{C,S}$+45 psig).

In one or more embodiments, the bottoms 128 can be heated using one or more heat exchangers 115, and then introduced to one or more strippers 130. Within the stripper 130, the bottoms 128 can be selectively separated to provide an overhead via line 132 and a bottoms via line 32. In one or more embodiments, the overhead via line 132 can contain a first portion of one or more solvent(s), and the bottoms 32 can contain a mixture of insoluble asphaltenes and the balance of the one or more solvent(s). In one or more embodiments, steam can be added via line 134 to the stripper 130 to enhance the separation of the one or more solvents from the DAO. In one or more embodiments, the steam in line 134 can be at a pressure ranging from about 200 kPa (15 psig) to about 2,160 kPa (300 psig); from about 300 kPa (30 psig) to about 1,475 kPa (200 psig); or from about 400 kPa (45 psig) to about 1,130 kPa (150 psig). In one or more embodiments, the bottoms in line 128 can be heated to a temperature of about 100° C. (210° F.) to about $T_{C,S}$+150° C. ($T_{C,S}$+270° F.); about 150° C. (300° F.) to about $T_{C,S}$+100° C. ($T_{C,S}$+180° F.); or about 300° C. (570° F.) to about $T_{C,S}$+50° C. ($T_{C,S}$+90° F.) using one or more heat exchangers 115. In one or more embodiments, the solvent concentration in the overhead in line 132 can range from about 70% wt to about 99% wt; or about 85% wt to about 99% wt. In one or more embodiments, the DAO concentration in the overhead in line 132 can range from about 0% wt to about 50% wt; about 1% wt to about 30% wt; or about 1% wt to about 15% wt.

In one or more embodiments, the solvent concentration in the bottoms 32 can range from about 5% wt to about 80% wt; about 20% wt to about 60% wt; or about 25% wt to about 50% wt. In one or more embodiments, at least a portion of the bottoms 32 can be further processed, dried and pelletized to provide a solid hydrocarbon product. In one or more embodiments, at least a portion of the bottoms 32 can be subjected to further processing, including but not limited to gasification, power generation, process heating, or combinations thereof. In one or more embodiments, at least a portion of the bottoms 32 can be sent to a gasifier to produce steam, power, and hydrogen. In one or more embodiments, at least a portion of the bottoms 32 can be used as fuel to produce steam and power. In one or more embodiments, the asphaltene concentration in the bottoms 32 can range from about 20% wt to about 95% wt; about 40% wt to about 80% wt; or about 50% wt to about 75% wt. In one or more embodiments, the specific gravity (at 60° F.) of the bottoms 32 can range from about 5° API to about 30° API; about 5° API to about 20° API; or about 5° API to about 15° API.

The one or more heat exchangers 115 can include any system or device suitable for increasing the temperature of the bottoms in line 128. Illustrative heat exchangers, systems or devices can include, but are not limited to, shell-and-tube, plate and frame, or spiral wound heat exchanger designs. In one or more embodiments, a heating medium such as steam, hot oil, hot process fluids, electric resistance heat, hot waste fluids, or combinations thereof can be used to transfer the necessary heat to the bottoms in line 128. In one or more embodiments, the one or more heat exchangers 115 can be a direct fired heater or the equivalent. In one or more embodiments, the one or more heat exchangers 115 can operate at a temperature of about 25° C. (80° F.) to about $T_{C,S}$+150° C. ($T_{C,S}$+270° F.); about 25° C. (80° F.) to about $T_{C,S}$+100° C. ($T_{C,S}$+180° F.); or about 25° C. (80° F.) to about $T_{C,S}$+50° C. ($T_{C,S}$+90° F.). In one or more embodiments, the one or more heat exchangers 115 can operate at a pressure of about 100 kPa (0 psig) to about $P_{C,S}$+700 kPa ($P_{C,S}$+100 psig); about 100 kPa to about $P_{C,S}$+500 kPa ($P_{C,S}$+75 psig); or about 100 kPa to about $P_{C,S}$+300 kPa ($P_{C,S}$+45 psig).

The one or more asphaltene strippers 130 can include any system or device suitable for selectively separating the bottoms in line 128 to provide an overhead in line 132 and a bottoms 32. In one or more embodiments, the asphaltene stripper 130 can include, but is not limited to internals such as rings, saddles, balls, irregular sheets, tubes, spirals, trays, baffles, or the like, or any combinations thereof. In one or more embodiments, the asphaltene separator 130 can be an open column without internals. In one or more embodiments, the one or more asphaltene strippers 130 can operate at a temperature of about 30° C. (85° F.) to about 600° C. (1,110° F.); about 100° C. (210° F.) to about 550° C. (1,020° F.); or about 300° C. (570° F.) to about 550° C. (1,020° F.). In one or more embodiments, the one or more asphaltene strippers 130 can operate at a pressure of about 100 kPa (0 psig) to about 4,000 kPa (565 psig); about 500 kPa (60 psig) to about 3,300 kPa (465 psig); or about 1,000 kPa (130 psig) to about 2,500 kPa (350 psig).

The overhead in line 122 can be heated using one or more heat exchangers 145, 148 thereby providing a heated overhead via line 124. In one or more embodiments, the temperature of the heated overhead in line 124 can be increased above the critical temperature of the solvent(s) $T_{C,S}$. In one or more embodiments, the temperature of the heated overhead in line 124 can be increased using one or more heat exchangers 145 and/or 148 to a range from about 25° C. (80° F.) to about $T_{C,S}$+150° C. ($T_{C,S}$+270° F.); about $T_{C,S}$−100° C. ($T_{C,S}$−180° F.) to about $T_{C,S}$+100° C. ($T_{C,S}$+180° F.); or about $T_{C,S}$−50° C. ($T_{C,S}$−90° F.) to about $T_{C,S}$+50° C. ($T_{C,S}$+90° F.).

The one or more heat exchangers 145, 148 can include any system or device suitable for increasing the temperature of the overhead in line 122. In one or more embodiments, the heat exchanger 145 can be a regenerative type heat exchanger using a heated process stream, for example an overhead via line 152 from the separator 150, to heat the overhead in line 122 prior to introduction to the separator 150. In one or more embodiments, the one or more heat exchangers 145, 148 can operate at a temperature of about 25° C. (80° F.) to about $T_{C,S}$+150° C. ($T_{C,S}$+270° F.); about $T_{C,S}$−100° C. ($T_{C,S}$−180° F.) to about $T_{C,S}$+100° C. ($T_{C,S}$+180° F.); or about $T_{C,S}$−50° C. ($T_{C,S}$−90° F.) to about $T_{C,S}$+50° C. ($T_{C,S}$+90° F.). In one or more embodiments, the one or more heat exchangers 145, 148 can operate at a pressure of about 100 kPa (0 psig) to about $P_{C,S}$+700 kPa ($P_{C,S}$+100 psig); about 100 kPa (0 psig) to about $P_{C,S}$+500 kPa ($P_{C,S}$+75 psig); or about 100 kPa (0 psig) to about $P_{C,S}$+300 kPa ($P_{C,S}$+45 psig).

The heated overhead in line 124, containing a mixture of DAO and one or more solvents can be introduced into the one or more separators 150 and selectively separated therein to provide an overhead via line 152 and a bottoms via line 158. In one or more embodiments, the overhead in line 152 can contain a first portion of the one or more solvent(s), and the bottoms in line 158 can contain DAO and the balance of the one or more solvent(s). In one or more embodiments, the solvent concentration in the overhead in line 152 can range from about 50% wt to about 100% wt; about 70% wt to about 99% wt; or about 85% wt to about 99% wt. In one or more embodiments, the DAO concentration in the overhead in line 152 can contain from about 0% wt to about 50% wt; about 1% wt to about 30% wt; or about 1% wt to about 15% wt.

In one or more embodiments, the DAO concentration in the bottoms in line 158 can range from about 20% wt to about 95% wt; about 40% wt to about 80% wt; or about 50% wt to about 75% wt. In one or more embodiments, the solvent concentration in the bottoms in line 158 can range from about 5% wt to about 80% wt; about 20% wt to about 60% wt; or about 25% wt to about 50% wt. In one or more embodiments, the specific gravity (at 60° F.) of the bottoms in line 158 can range from about 5° API to about 30° API; about 5° API to about 20° API; or about 5° API to about 15° API.

The one or more separators 150 can include any system or device suitable for separating DAO and one or more solvents to provide an overhead in line 152 and the bottoms in line 158. In one or more embodiments, the separator 150 can contain internals such as rings, saddles, structured packing, balls, irregular sheets, tubes, spirals, trays, baffles, or any combinations thereof. In one or more embodiments, the separator 150 can be an open column without internals. In one or more embodiments, the separator 150 can operate at a temperature of about 15° C. (60° F.) to about 600° C. (1,110° F.); about 15° C. (60° F.) to about 500° C. (930° F.); or about 15° C. (60° F.) to about 400° C. (750° F.). In one or more embodiments, the separators 150 can operate at a pressure of about 101 kPa (0 psig) to about 700 kPa (100 psig) above the critical pressure of the solvent(s) ("$P_{C,S}$"); about $P_{C,S}$−700 kPa ($P_{C,S}$−100 psig) to about $P_{C,S}$+700 kPa ($P_{C,S}$+100 psig); or about $P_{C,S}$−300 kPa ($P_{C,S}$−45 psig) to about $P_{C,S}$+300 kPa ($P_{C,S}$+45 psig).

In one or more embodiments, at least a portion of the bottoms in line 158 can be directed to one or more strippers 160 and selectively separated therein to provide an overhead via line 162 and a bottoms via line 37. In one or more embodiments, the overhead in line 162 can contain a first portion of the one or more solvents, and the bottoms in line 37 can contain DAO and the balance of the one or more solvents. In one or more embodiments, steam can be added via line 164 to the stripper 160 to enhance the separation of the one or more solvents from the DAO. In one or more embodiments, the steam in line 164 can be at a pressure ranging from about 200 kPa (15 psig) to about 2,160 kPa (300 psig); from about 300 kPa (30 psig) to about 1,475 kPa (200 psig); or from about 400 kPa (45 psig) to about 1,130 kPa (150 psig). In one or more embodiments, the solvent concentration in the overhead in line 162 can range from about 70% wt to about 100% wt; about 85% wt to about 99.9% wt; or about 90% wt to about 99.9% wt. In one or more embodiments, the DAO concentration in the overhead in line 162 can contain from about 0% wt to about 30% wt; about 0.1% wt to about 15% wt; or about 0.1% wt to about 10% wt.

In one or more embodiments, the DAO concentration in the bottoms in line 37 can range from about 20% wt to about 100% wt; about 40% wt to about 97% wt; or about 50% wt to about 95% wt. In one or more embodiments, the solvent concentration in the bottoms in line 37 can range from about 0% wt to about 80% wt; about 3% wt to about 60% wt; or about 5% wt to about 50% wt. In one or more embodiments, the specific gravity (at 60° F.) of the bottoms in line 37 can range from about 5° API to about 30° API; about 5° API to about 20° API; or about 5° API to about 15° API.

The one or more strippers 160 can include any system or device suitable for separating DAO and one or more solvents to provide an overhead via line 162 and the bottoms via line 37. In one or more embodiments, the stripper 160 can contain internals such as rings, saddles, structured packing, balls, irregular sheets, tubes, spirals, trays, baffles, or any combinations thereof. In one or more embodiments, the stripper 160 can be an open column without internals. In one or more embodiments, the stripper 160 can operate at a temperature of about 15° C. (60° F.) to about 600° C. (1,110° F.); about 15° C. (60° F.) to about 500° C. (930° F.); or about 15° C. (60° F.) to about 400° C. (750° F.). In one or more embodiments, the pressure in the stripper 160 can range from about 100 kPa (0 psig) to about 4,000 kPa (565 psig); about 500 kPa (60 psig) to about 3,300 kPa (465 psig); or about 1,000 kPa (130 psig) to about 2,500 kPa (350 psig).

In one or more embodiments, at least a portion of the one or more solvent overheads in lines 132 and 162 can be combined to provide recycled solvent via line 138. In one or more embodiments, the recycled solvent in line 138 can be a two phase mixture containing both liquid and vapor. In one or more embodiments, the temperature of the recycled solvent in line 138 can range from about 30° C. (85° F.) to about 600° C. (1,110° F.); about 100° C. (210° F.) to about 550° C. (1,020° F.); or about 300° C. (570° F.) to about 500° C. (930° F.).

In one or more embodiments, the recycled solvent in line 138 can be condensed using the one or more condensers 135, thereby providing one or more cooled solvents in line 139. In one or more embodiments, the cooled solvent(s) in stream 139 can have a temperature of about 10° C. (50° F.) to about 400° C. (750° F.); about 25° C. (80° F.) to about 200° C. (390°); or about 30° C. (85° F.) to about 100° C. (210° F.). The solvent concentration in line 139 can range from about 80% wt to about 100% wt; about 90% wt to about 99% wt; or about 95% wt to about 99% wt.

The one or more condensers 135 can include any system or device suitable for decreasing the temperature of the recycled solvents in line 138 to provide a condensed solvent via line 139. In one or more embodiments, condenser 135 can include, but is not limited to liquid or air cooled shell-and-tube, plate and frame, fin-fan, or spiral wound cooler designs. In one or more embodiments, a cooling medium such as water, refrigerant, air, or combinations thereof can be used to remove the necessary heat from the recycled solvents in line 138. In one or more embodiments, the one or more condensers 135 can operate at a temperature of about −20° C. (−5°) to about $T_{C,S}$° C.; about −10° C. (15° F.) to about 300° C. (570° F.); or about 0° C. (30° F.) to about 300° C. (570° F.). In one or more embodiments, the one or more condensers 135 can operate at a pressure of about 100 kPa (0 psig) to about $P_{C,S}$+700 kPa ($P_{C,S}$+90 psig); or about 100 kPa (0 psig) to about $P_{C,S}$+500 kPa ($P_{C,S}$+60 psig); or about 100 kPa (0 psig) to about $P_{C,S}$+300 kPa ($P_{C,S}$+30 psig).

At least a portion of the condensed solvent in line 139 can be stored in the one or more accumulators 140. At least a portion of the solvent in the accumulator 140 can be recycled via line 186 using one or more pumps 192. The recycled solvent in line 186 can be combined with at least a portion of the solvent overhead in line 152 to provide a solvent recycle via line 177. A first portion of the recycled solvent in line 177 can be recycled to the mixer 110 in the solvent deasphalting process 30.

A second portion of the solvent in line 177 can be recycled via line 35 to the mixer 10 (ref. FIG. 1). The temperature of the recycled solvent in line 35 can be adjusted by passing the appropriate heating or cooling media through one or more heat exchangers 175. In one or more embodiments, the temperature of the solvent in line 35 can range from about 10° C. (50° F.) to about 400° C. (750° F.); about 25° C. (80° F.) to about 200° C. (390°); or about 30° C. (85° F.) to about 100° C. (210° F.). The solvent concentration in line 35 can range from about 80% wt to about 100% wt; about 90% wt to about 99% wt; or about 95% wt to about 99% wt.

The one or more heat exchangers 175 can include, but is not limited to liquid or air cooled shell-and-tube, plate and frame, fin-fan, or spiral wound cooler designs. In one or more embodiments, the one or more heat exchangers 175 can operate at a temperature of about −20° C. (−50) to about $T_{C,S}$° C.; about −10° C. (15° F.) to about 300° C. (570° F.); or about 0° C. (30° F.) to about 300° C. (570° F.). In one or more embodiments, the one or more condensers 135 can operate at a pressure of about 100 kPa (0 psig) to about $P_{C,S}$+700 kPa ($P_{C,S}$+90 psig); or about 100 kPa (0 psig) to about $P_{C,S}$+500 kPa ($P_{C,S}$+60 psig); or about 100 kPa (0 psig) to about $P_{C,S}$+300 kPa ($P_{C,S}$+30 psig).

Figure 3:
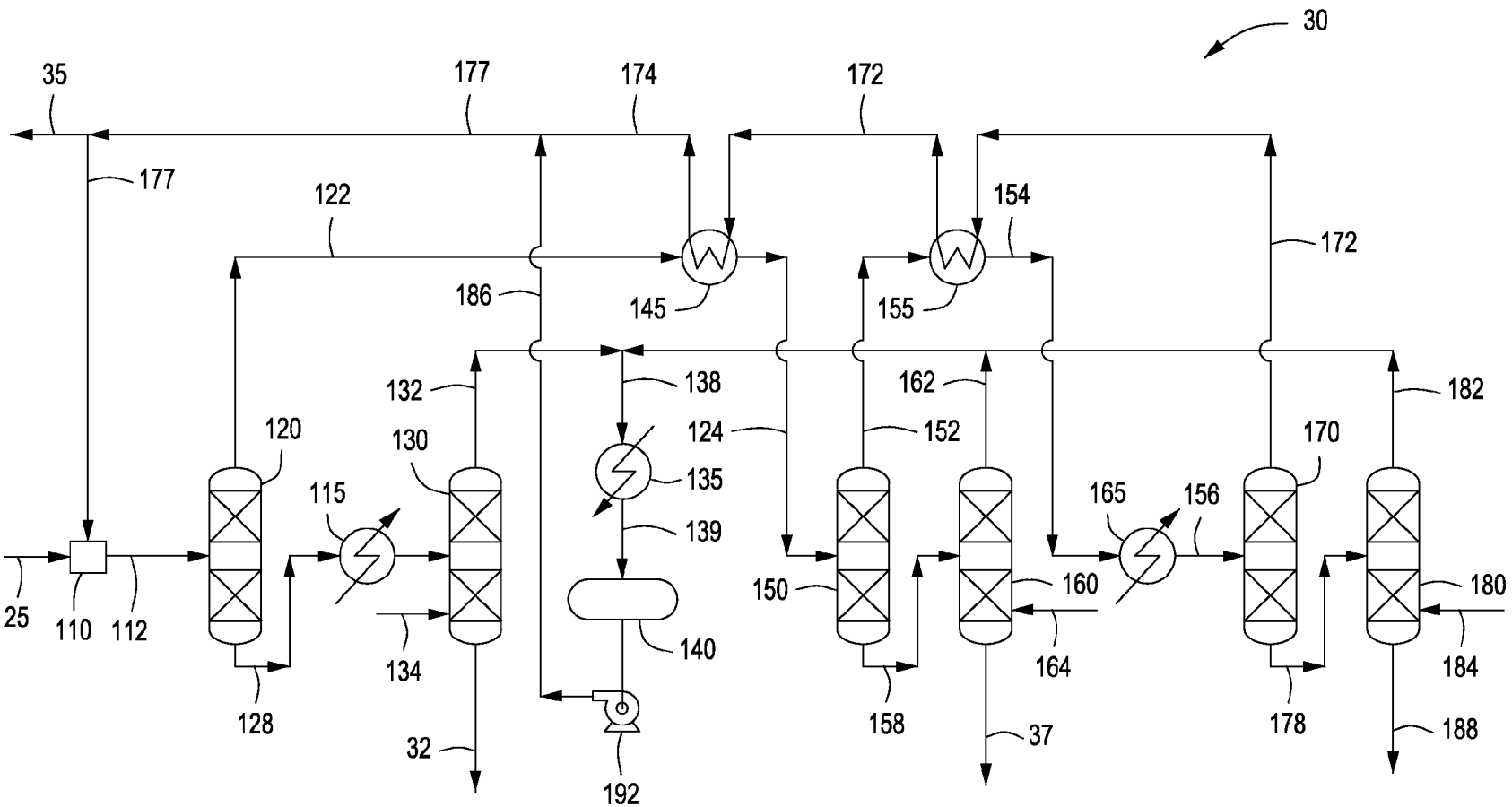
FIG. 3 depicts yet another illustrative solvent extraction system for use with an integrated deasphalting and dewatering system, according to one or more embodiments described.

FIG. 3 depicts another illustrative solvent extraction system for use with an integrated deasphalting and dewatering system, according to one or more embodiments. In addition to the system shown and described above with reference to FIG. 2, the extraction system 30 can further include one or more separators 170 and strippers 180 for the selective separation of the DAO overhead 122 into a heavy deasphalted oil ("resin") fraction via line 37 and a light deasphalted oil fraction via line 188.

The term "light deasphalted oil" ("light-DAO") as used herein refers to a hydrocarbon or mixture of hydrocarbons sharing similar physical properties and containing less than 5%, 4%, 3%, 2% or 1% asphaltenes. In one or more embodiments, the similar physical properties can include a boiling point of about 315° C. to about 610° C.; a viscosity of about 40 cSt to about 65 cSt at 50° C.; and a flash point of about 130° C. or more.

The term "heavy deasphalted oil" ("heavy-DAO") as used herein refers to a hydrocarbon or mixture of hydrocarbons sharing similar physical properties and containing less than 5%, 4%, 3%, 2% or 1% asphaltenes. In one or more embodiments, the similar physical properties can include a boiling point of about 400° C. to about 800° C.; a viscosity of about 50 cSt to about 170 cSt at 50° C.; and a flash point of about 150° C. or more.

In one or more embodiments, the temperature of the asphaltene separator overhead in line 122 can be increased using one or more heat exchangers 145 to provide a heated overhead via line 124. The temperature of the heated overhead in line 124 can range from sub-critical to supercritical based upon the critical temperature ("$T_{C,S}$") of the particular solvent. In one or more embodiments, the temperature of the heated overhead in line 124 can be increased above the critical temperature of the solvent in line 124 and introduced to the one or more separators 150 to provide a first phase containing a heavy-DAO fraction and at least a portion of the one solvent (s), and a second phase containing a light-DAO fraction and the balance of the one or more solvent(s). In one or more embodiments, the temperature of the heated overhead in line 124 can range from about 15° C. (60° F.) to about $T_{C,S}$+150° C. ($T_{C,S}$+270° F.); about 15° C. (60° F.) to about $T_{C,S}$+100° C. ($T_{C,S}$+210° F.); or about 15° C. (60° F.) to about $T_{C,S}$+50° C. ($T_{C,S}$+90° F.).

The light-DAO in the overhead 152 can range from about 1% wt to about 50% wt; about 5% wt to about 40% wt; or about 10% wt to about 30% wt. In one or more embodiments, the solvent concentration in the overhead in line 152 can range from about 50% wt to about 99% wt; about 60% wt to about 95% wt; or about 70% wt to about 90% wt. In one or more embodiments, the overhead in line 152 can contain less than about 20% wt heavy-DAO; less than about 10% wt heavy-DAO; or less than about 5% wt heavy-DAO.

The heavy-DAO concentration in the bottoms 158 can range from about 10% wt to about 90% wt; about 25% wt to about 80% wt; or about 40% wt to about 70% wt. In one or more embodiments, the solvent concentration in the bottoms in line 158 can range from about 10% wt to about 90% wt; about 20% wt to about 75% wt; or about 30% wt to about 60% wt.

The one or more separators 150 can include any system or device suitable for separating the heated overhead in line 124 to provide an overhead via line 152 and a bottoms via line 158. In one or more embodiments, the separator 150 can include one or more multi-staged extractors having alternate segmental baffle trays, packing, perforated trays or the like, or combinations thereof. In one or more embodiments, the separator 150 can be an open column without internals. In one or more embodiments, the temperature in the one or more separators 150 can range from about 15° C. (60° F.) to about $T_{C,S}$+150° C. ($T_{C,S}$+270° F.); about 15° C. (60° F.) to about $T_{C,S}$+100° C. ($T_{C,S}$+210° F.); or about 15° C. (60° F.) to about $T_{C,S}$+50° C. ($T_{C,S}$+90° F.). In one or more embodiments, the pressure in the one or more separators 150 can range from about 100 kPa (0 psig) to about $P_{C,S}$+700 kPa ($P_{C,S}$+90 psig); about $P_{C,S}$−700 kPa ($P_{C,S}$−90 psig) to about $P_{C,S}$+700 kPa ($P_{C,S}$+90 psig); or about $P_{C,S}$−300 kPa ($P_{C,S}$−30 psig) to about $P_{C,S}$+300 kPa ($P_{C,S}$+30 psig).

The bottoms in line 158, containing heavy-DAO, can be introduced into the one or more strippers 160 and selectively separated therein to provide an overhead, containing solvent, via line 162 and a bottoms, containing heavy-DAO, via line 37. In one or more embodiments, steam via line 164 can be added to the stripper 160 to enhance the separation of the solvent from the heavy-DAO. The overhead in line 162 can contain a first portion of the solvent, and the bottoms in line 37 can contain heavy-DAO and the balance of the solvent. In one or more embodiments, at least a portion of the bottoms in line 37 can be directed for further processing including, but not limited to, upgrading through hydrotreating, catalytic cracking, or a combination thereof. In one or more embodiments, the solvent concentration in the overhead in line 162 can range from about 50% wt to about 100% wt; about 70% wt to about 99% wt; or about 85% wt to about 99% wt. In one or more embodiments, the heavy-DAO concentration in the overhead in line 162 can range from about 0% wt to about 50% wt; about 1% wt to about 30% wt; or about 1% wt to about 15% wt.

In one or more embodiments, the heavy-DAO concentration in the bottoms in line 37 can range from about 20% wt to about 95% wt; about 40% wt to about 80% wt; or about 50% wt to about 75% wt. In one or more embodiments, the solvent concentration in the bottoms in line 37 can range from about 5% wt to about 80% wt; about 20% wt to about 60% wt; or about 25% wt to about 50% wt. In one or more embodiments, the specific gravity (API 60° F.) of the bottoms in line 37 can range from about 50 to about 300; about 50 to about 200; or about 50 to about 15°.

The one or more strippers 160 can include any system or device suitable for separating the heavy-DAO and solvents present in the bottoms in line 158 to provide an overhead via line 162 and a bottoms via line 37. In one or more embodiments, the stripper 160 can contain internals such as rings, saddles, structured packing, balls, irregular sheets, tubes, spirals, trays, baffles, or any combinations thereof. In one or more embodiments, the stripper 160 can be an open column without internals. In one or more embodiments, the operating temperature of the one or more strippers 160 can range from about 15° C. (60° F.) to about 600° C. (1,110° F.); about 15° C. (60° F.) to about 500° C. (930° F.); or about 15° C. (60° F.) to about 400° C. (750° F.). In one or more embodiments, the pressure of the one or more strippers 160 can range from about 100 kPa (0 psig) to about 4,000 kPa (565 psig); about 500 kPa (60 psig) to about 3,300 kPa (465 psig); or about 1,000 kPa (130 psig) to about 2,500 kPa (350 psig).

In one or more embodiments, the light-DAO rich overhead in line 152 can be heated using one or more heat exchangers (two are shown 155, 165) to provide a heated overhead in line 154. The temperature of the heated overhead in line 154 can range from about 15° C. (60° F.) to about $T_{C,S}$+150° C. ($T_{C,S}$+270° F.); about 15° C. (60° F.) to about $T_{C,S}$+100° C. ($T_{C,S}$+180° F.); or about 15° C. (60° F.) to about $T_{C,S}$+50° C. ($T_{C,S}$+90° F.).

In one or more embodiments, the temperature from the heat exchangers 155, 165 can range from about 15° C. (60° F.) to about $T_{C,S}$+150° C. ($T_{C,S}$+270° F.); about 15° C. (60° F.) to about $T_{C,S}$+100° C. ($T_{C,S}$+180° F.); or about 15° C. (60° F.) to about $T_{C,S}$+50° C. ($T_{C,S}$+90° F.). The heat exchangers 155, 165 can operate at a pressure of about 100 kPa (0 psig) to about $P_{C,S}$+700 kPa ($P_{C,S}$+100 psig); about 100 kPa (0 psig) to about $P_{C,S}$+500 kPa ($P_{C,S}$+75 psig); or about 100 kPa (0 psig) to about $P_{C,S}$+300 kPa ($P_{C,S}$+45 psig).

In one or more embodiments, the heated overhead in line 156 can be introduced to the one or more separators 170 and selectively separated therein to provide an overhead via line 172 and a bottoms via line 178. The overhead 172 can contain at least a portion of the one or more solvent(s), and the bottoms 178 can contain a mixture of light-DAO and the balance of the one or more solvent(s). The solvent concentration in line 172 can range from about 50% wt to about 100% wt; about 70% wt to about 99% wt; or about 85% wt to about 99% wt. In one or more embodiments, the light-DAO concentration in line 172 can range from about 0% wt to about 50% wt; about 1% wt to about 30% wt; or about 1% wt to about 15% wt.

In one or more embodiments, the light-DAO concentration in line 178 can range from about 10% wt to about 90% wt; about 25% wt to about 80% wt; or about 40% wt to about 70% wt. In one or more embodiments, the solvent concentration in line 178 can range from about 10% wt to about 90% wt; about 20% wt to about 75% wt; or about 30% wt to about 60% wt.

The one or more separators 170 can include any system or device suitable for separating the heated overhead in line 156 to provide an overhead containing solvent via line 172 and a light-DAO rich bottoms via line 178. In one or more embodiments, the separator 170 can include one or more multi-staged extractors having alternate segmental baffle trays, packing, structured packing, perforated trays, and combinations thereof. In one or more embodiments, the separator 170 can be an open column without internals. In one or more embodiments, the separators 170 can operate at a temperature of about 15° C. (60° F.) to about $T_{C,S}$+150° C. ($T_{C,S}$+270° F.); about 15° C. (60° F.) to about $T_{C,S}$+150° C. ($T_{C,S}$+270° F.); or about 15° C. (60° F.) to about $T_{C,S}$+50° C. ($T_{C,S}$+90° F.). In one or more embodiments, the separators 170 can operate at a pressure of about 100 kPa (0 psig) to about $P_{C,S}$+700 kPa ($P_{C,S}$+100 psig); about $P_{C,S}$−700 kPa ($P_{C,S}$−100 psig) to about $P_{C,S}$+700 kPa ($P_{C,S}$+100 psig); or about $P_{C,S}$−300 kPa ($P_{C,S}$−45 psig) to about $P_{C,S}$+300 kPa ($P_{C,S}$+45 psig).

In one or more embodiments, the bottoms, containing light-DAO, in line 178 can be introduced into the one or more strippers 180 and selectively separated therein to provide an overhead via line 182 and a bottoms via line 188. In one or more embodiments, the overhead in line 182 can contain at least a portion of the one or more solvent(s), and the bottoms in line 188 can contain a mixture of light-DAO and the balance of the one or more solvent(s). In one or more embodiments, steam via line 184 can be added to the stripper to enhance the separation of the one or more solvents from the light-DAO. In one or more embodiments, at least a portion of the light-DAO in line 188 can be directed for further processing including, but not limited to hydrocracking. In one or more embodiments, the solvent concentration in the overhead in line 182 can range from about 50% wt to about 100% wt; about 70% wt to about 99% wt; or about 85% wt to about 99% wt. In one or more embodiments, the light-DAO concentration in line 182 can range from about 0% wt to about 50% wt; about 1% wt to about 30% wt; or about 1% wt to about 15% wt.

In one or more embodiments, the light-DAO concentration in the bottoms in line 188 can range from about 20% wt to about 95% wt; about 40% wt to about 90% wt; or about 50% wt to about 85% wt. In one or more specific embodiments, the light-DAO concentration in the bottoms in line 188 can be as high as 100% wt. In one or more embodiments, the solvent concentration in line 188 can range from about 5% wt to about 80% wt; about 10% wt to about 60% wt; or about 15% wt to about 50% wt. In one or more embodiments, the specific gravity (API 60° F.) of the bottoms in line 188 can range from about 10° to about 60°; about 20° to about 50°; or about 25° to about 45°.

In one or more embodiments, the one or more strippers 180 can contain internals such as rings, saddles, structured packing, balls, irregular sheets, tubes, spirals, trays, baffles, or any combinations thereof. In one or more embodiments, the stripper 180 can be an open column without internals. In one or more embodiments, the one or more strippers 180 can operate at a temperature of about 15° C. (60° F.) to about $T_{C,S}$+150° C. ($T_{C,S}$+270° F.); about 15° C. (60° F.) to about $T_{C,S}$+150° C. ($T_{C,S}$+270° F.); or about 15° C. (60° F.) to about $T_{C,S}$+50° C. ($T_{C,S}$+90° F.). In one or more embodiments, the one or more strippers 180 can operate at a pressure of about 100 kPa (0 psig) to about $P_{C,S}$+700 kPa ($P_{C,S}$+100 psig); about $P_{C,S}$−700 kPa ($P_{C,S}$−100 psig) to about $P_{C,S}$+700 kPa ($P_{C,S}$+100 psig); or about $P_{C,S}$−300 kPa ($P_{C,S}$−45 psig) to about $P_{C,S}$+300 kPa ($P_{C,S}$+45 psig).

In one or more embodiments, at least a portion of the solvent in the overhead in lines 132, 162 and 182 can be combined to provide a combined solvent in the overhead in line 138. In one or more embodiments, the solvent in the combined solvent overhead in line 138 can be present as a two phase liquid/vapor mixture. In one or more embodiments, the combined solvent overhead in line 138 can be fully condensed using one or more condensers 135 to provide a condensed solvent via line 139. In one or more embodiments the condensed solvent in line 139 can be stored or accumulated using one or more accumulators 140. The solvent(s) stored in the one or more accumulators 140 for recycle within the extraction unit 30 and/or mixer 10 (ref. FIG. 1), can be transferred using one or more solvent pumps 192 and recycle line 186. In one or more embodiments, the combined solvent overhead in line 138 can have a temperature of about 30° C. (85° F.) to about 600° C. (1,110° F.); about 100° C. (210° F.) to about 550° C. (1,020° F.); or about 300° C. (570° F.) to about 550° C. (1,020° F.). In one or more embodiments, the condensed solvent in line 139 can have a temperature of about 10° C. (50° F.) to about 400° C. (750° F.); about 25° C. (80° F.) to about 200° C. (390° F.); or about 30° C. (85° F.) to about 100° C. (210° F.). The solvent concentration in line 139 can range from about 80% wt to about 100% wt; about 90% wt to about 99% wt; or about 95% wt to about 99% wt.

The one or more condensers 135 can include any system or device suitable for decreasing the temperature of the combined solvent overhead in line 138. In one or more embodiments, condenser 135 can include, but is not limited to liquid or air cooled shell-and-tube, plate and frame, fin-fan, or spiral wound cooler designs. In one or more embodiments, a cooling medium such as water, refrigerant, air, or combinations thereof can be used to remove the necessary heat from the combined solvent overhead in line 138. In one or more embodiments, the one or more condensers 135 can operate at a temperature of about −20° C. (−5° F.) to about $T_{C,S}$° C.; about −10° C. (15° F.) to about 300° C. (570° F.); or about 0° C. (30° F.) to about 300° C. (570° F.). In one or more embodiments, the one or more coolers 175 can operate at a pressure of about 100 kPa (0 psig) to about $P_{C,S}$+700 kPa ($P_{C,S}$+100 psig); about 100 kPa (0 psig) to about $P_{C,S}$+500 kPa ($P_{C,S}$+75 psig); or about 100 kPa (0 psig) to about $P_{C,S}$+300 kPa ($P_{C,S}$+45 psig).

In one or more embodiments, at least a portion of the overhead in line 172 can be cooled using one or more heat exchangers 145 and 155 to provide a cooled overhead in line 174. In one or more embodiments, at least a portion of the cooled overhead in line 174 can be combined with at least a portion of the solvent in line 186 and recycled to the one or more mixers 110 in the extraction unit 30 via line 177. In one or more embodiments, at least a portion of the cooled overhead in line 177 can be recycled to mixer 10 in the dewatering process (ref. FIG. 1) via line 35. In one or more embodiments, about 1% wt to about 95% wt; about 5% wt to about 55% wt; or about 1% wt to about 25% wt of overhead in line 172 can be cooled using one or more heat exchangers 145, 155, and one or more coolers 175. Recycling at least a portion of the solvent to either the solvent deasphalting process depicted in FIG. 3 and/or the dewatering process depicted in FIG. 1 can decrease the quantity of fresh solvent make-up required. In one or more embodiments, prior to introduction to the one or more heat exchangers 155, the overhead in line 172 can be at a temperature of about 25° C. (80° F.) to about $T_{C,S}$; about 150° C. (300° F.) to about $T_{C,S}$; or about 200° C. (390° F.) to about $T_{C,S}$. In one or more embodiments, after exiting the one or more heat exchangers 145, 155, the temperature of the cooled overhead in line 174 can range from about 25° C. (80°) to about 400° C. (750° F.); about 50° C. (120° F.) to about 300° C. (570° F.); or about 100° C. (210° F.) to about 250° C. (480° F.).

Figure 4:
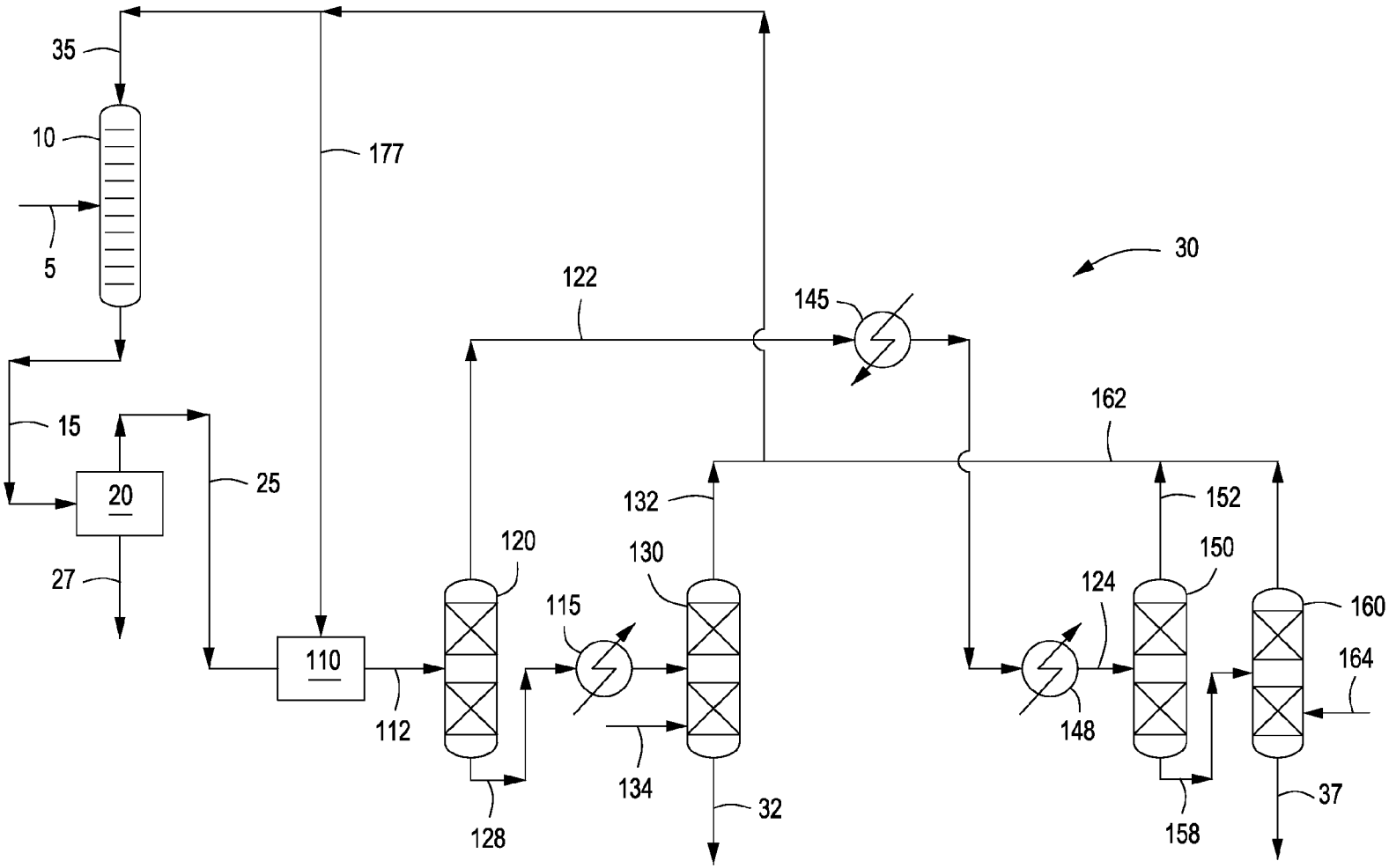
FIG. 4 depicts yet another illustrative solvent extraction system for use with an integrated deasphalting and dewatering system, according to one or more embodiments described.

FIG. 4 depicts another illustrative solvent deasphalting and dewatering system, according to one or more embodiments. The solvent deasphalting system can include the separators 120, 150 and the strippers 130, 160 as discussed above with reference to FIG. 2. In one or more embodiments, solvent from the stripper 130 overhead 132, the separator 150 overhead 152 and/or the stripper 160 overhead 162 can be combined to provide a partially or completely vaporized solvent mixture in line 177. A first portion of the partially or completely vaporized solvent mixture in line 177 can be recycled to the mixer 110, and a second portion thereof can be recycled via line 35 to the mixer 10.

The mixer 10 can be a gas absorption vessel wherein the incoming hydrocarbon feedstock in line 5 can be mixed or otherwise combined with a partially or completely vaporized solvent introduced via line 35. In one or more embodiments, the mixer 10 can be a column containing internal trays, structured packing, random packing or any combination thereof, to increase contact and mixing within the column. While the recycle of the partially or completely vaporized solvent mixture is depicted with reference to a two stage solvent extraction system, the recycle of the partially or completely vaporized solvent can also be used with a three stage solvent extraction system as depicted and described with reference to FIG. 3.

In one or more embodiments, the temperature of the partially or completely vaporized solvent in line 35 can range from about 10° C. (50° F.) to about 400° C. (750° F.); about 25° C. (80° F.) to about 200° C. (390°); or about 30° C. (85° F.) to about 100° C. (210° F.). The solvent concentration in line 35 can range from about 80% wt to about 100% wt; about 90% wt to about 99% wt; or about 95% wt to about 99% wt. The solvent in line 35 can be greater than about 50% wt vapor; greater than about 75% wt vapor; greater than about 90% wt vapor; or greater than about 95% wt vapor with the balance liquid solvent.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for dewatering and deasphalting a crude oil comprising:

mixing a crude oil comprising hydrocarbons, asphaltenes and water with one or more solvents to provide a first mixture;

selectively separating the first mixture to provide an oil phase and a water phase, the oil phase comprising the hydrocarbons, asphaltenes and solvent;

selectively separating the asphaltenes from the oil phase to provide a deasphalted oil comprising at least a portion of the hydrocarbons and at least a portion of the solvent, and an asphaltene mixture comprising the asphaltenes, the balance of the hydrocarbons, and the balance of the solvent;

selectively separating the solvent from the asphaltene mixture; and recycling at least a portion of the separated solvent to the first mixture.

2. The method of claim 1 wherein the solvent comprises at least 50% by weight one or more paraffins, and olefins containing one to seven carbon atoms.

3. The method of claim 1 wherein the hydrocarbon feed has a specific gravity of from about 6° API to about 25° API, as measured according to ASTM D D4052 at 60° F.

4. The method of claim 1 wherein the oil phase is heated to a temperature less than the critical temperature of the solvent prior to separation into the deasphalted oil and the asphaltene mixture.

5. The method of claim 1 wherein the crude oil is whole crude oil.

6. The method of claim 1 further comprising:

separating the deasphalted oil from the one or more solvents; and recycling at least a portion of the separated solvent to the first mixture.

7. The method of claim 6, wherein the solvent is selectively separated from the deasphalted oil at a temperature greater than 15° C. and at a pressure greater than 101 kPa.

8. The method of claim 1, wherein the solvent and hydrocarbon feed are mixed at a ratio of from 0.4:1 to 10:1 by weight.

9. The method of claim 1, wherein the asphaltenes are selectively separated from the oil phase at a temperature greater than 15° C. and at a pressure greater than 101 kPa.

10. The method of claim 1, wherein the deasphalted oil is selectively separated from the oil phase at a temperature greater than 15° C. and at a pressure greater than 101 kPa.

11. The method of claim 1 further comprising:

heating the deasphalted oil to a first temperature;

selectively separating the heated deasphalted oil to provide a light deasphalted mixture comprising light deasphalted oil and at least a portion of the one or more solvents and a heavy deasphalted mixture comprising heavy deasphalted oil and the balance of the solvent;

selectively separating the light deasphalted oil from the solvent; and selectively separating the heavy deasphalted oil from the solvent.

12. The method of claim 11 further comprising recycling at least a portion of the separated solvent to the first mixture.

13. The method of claim 11 wherein the first temperature is greater than the critical temperature of the one or more solvents.

14. The method of claim 11 wherein the solvent is selectively separated from the light deasphalted oil at a temperature greater than 15° C. and at a pressure greater than 101 kPa.

15. The method of claim 11 wherein the solvent is selectively separated from the heavy deasphalted oil at a temperature greater than 15° C. and at a pressure greater than 101 kPa.

16. The method of claim 11 wherein the light deasphalted oil is hydrocracked at conditions sufficient to provide a product comprising kerosene, diesel, gas oil, gasoline, combinations thereof, derivatives thereof or mixtures thereof.

17. A method for dewatering and deasphalting a hydrocarbon feed comprising:

mixing a hydrocarbon feed comprising one or more hydrocarbons, one or more asphaltenes, and water with one or more solvents to provide a first mixture;

selectively separating the first mixture to provide a oil phase and a water phase, the oil phase comprising the hydrocarbons, the asphaltenes and the solvent;

selectively separating the one or more asphaltenes from the oil phase to provide a deasphalted oil comprising at least a portion of the one or more hydrocarbons and at least a portion of the one or more solvents, and an asphaltene mixture comprising the asphaltenes, the balance of the one or more hydrocarbons, and the balance of the one or more solvents;

selectively separating the one or more solvents from the deasphalted oil;

selectively separating the one or more solvents from the asphaltene mixture; and recycling at least a portion of the one or more separated solvents to the first mixture.

18. The method of claim 17 wherein the hydrocarbon feed comprises whole crude oil, crude oil, oil shales, oil sands, tars, bitumens, combinations thereof, derivatives thereof or mixtures thereof.

19. The method of claim 17 further comprising:

heating the deasphalted oil to supercritical conditions based upon the physical properties of the one or more solvents;

selectively separating the heated deasphalted oil to provide a light deasphalted mixture comprising light deasphalted oil and at least a portion of the one or more solvents and a heavy deasphalted mixture comprising heavy deasphalted oil and the balance of the one or more solvents;

selectively separating the light deasphalted oil from the one or more solvents; and selectively separating the heavy deasphalted oil from the one or more solvents.

20. The method of claim 19 wherein the solvent(s) and hydrocarbon feed are mixed at a ratio of from 0.4:1 to 10:1 by weight.

* * * * *